US006050406A

United States Patent [19]

Nomura et al.

[11] Patent Number: 6,050,406

[45] Date of Patent: Apr. 18, 2000

[54] STORAGE CASE FOR DIFFRACTION GRATING

[75] Inventors: Yoshimitsu Nomura; Masaaki Fukuda; Takashi Ito; Kaneyoshi Yagi, all of Saitama, Japan

[73] Assignee: Fuji Photo Optical Co., Ltd., Saitama, Japan

[21] Appl. No.: 09/120,463

[22] Filed: Jul. 23, 1998

[30] Foreign Application Priority Data

Sep. 25, 1997 [JP] Japan ..... 9-260175

[51] Int. Cl.[7] ..... B65D 85/38

[52] U.S. Cl. ..... 206/316.1; 206/446; 206/561

[58] Field of Search ..... 206/306, 316.1, 206/446, 560–565, 804, 815

[56] References Cited

U.S. PATENT DOCUMENTS

| | | | |
|---|---|---|---|
| 1,962,556 | 6/1934 | Eberhardt, Jr. | 206/565 |
| 2,551,710 | 5/1951 | Slaughter | 206/446 |
| 3,232,397 | 2/1966 | McCoy | 206/815 |
| 3,638,849 | 2/1972 | Goings | 206/564 |
| 4,684,013 | 8/1987 | Jacobs | 206/564 |
| 5,469,962 | 11/1995 | Kitagawa et al. | 206/564 |

*Primary Examiner*—Jim Foster
*Attorney, Agent, or Firm*—Leydig, Voit & Mayer, Ltd.

[57] ABSTRACT

Provided is a storage case for a diffraction grating, which accommodates the diffraction grating in a constant orientation, so as to improve efficiency in the operation for assembling the diffraction grating. The storage sections each accommodate a diffraction grating Each storage section forms a storage space for accommodating a diffraction grating. The storage space is equipped with a rib for engaging the outer peripheral portion of the diffraction grating.

9 Claims, 4 Drawing Sheets

STORAGE CASE FOR DIFFRACTION GRATING

BACKGROUND OF THE INVENTION

1. Field of the Invention

The present invention relates to a storage case for a diffraction grating, used for transportation, storage, and the like of a diffraction grating which is an optical element.

2. Related Background Art

A diffraction grating has been employed as one of optical elements in a light pickup optical system in an apparatus for reproducing a CD, CD-ROM, or DVD, and the like. The diffraction grating diffracts light emitted from a laser diode or the like and splits it into a plurality of rays. The surface of the diffraction grating is formed with minute irregularities which diffract the light transmitted through the diffraction grating. The laser rays split by the diffraction grating irradiate a disc such as CD, thus forming a main beam and a pair of side beams. For reading out information of the disc, the main beam and side beams must be irradiated in a predetermined positional relationship. In order for the main beam and side beams to be irradiated in such a manner, it is necessary for the diffraction grating to be installed in the light pickup optical system with its irregularities oriented in a predetermined direction.

Meanwhile, after being manufactured, a number of diffraction gratings are shipped as being accommodated together in a storage package. Then, at their receiving end, the diffraction gratings are individually taken out from the storage package and are assembled into light pickup optical systems. As such a storage package, the one shown in FIG. 6 has been known, for example. This storage package A is formed by blowing or the like and is provided with a number of recesses B for receiving diffraction gratings C. As the diffraction gratings C are accommodated in the recesses B one by one, the number of diffraction gratings can be accommodated in the storage package A.

SUMMARY OF THE INVENTION

The conventional storage package A for diffraction gratings, however, has shortcomings in that light pickup optical systems may not be assembled efficiently. Namely, as shown in FIG. 6, while the diffraction gratings C are accommodated in the recesses B of the storage package A one by one, minute irregularities D of the diffraction gratings C are not always oriented in a constant direction. Even if the orientation of the irregularities D is set upon accommodation of the diffraction grating C, the latter may rotate within the recess B, as indicated by arrows in FIG. 6, after it is shipped till it is received. As a result, eventually, the irregularities D of the diffraction grating C may not be oriented in a predetermined direction. In such a storage state, in order to take out the diffraction gratings C one by one for assembling them, each diffraction grating C must be appropriately rotated upon its assembling, such that the irregularities D of the diffraction grating C are oriented in a proper direction with respect to its corresponding light pickup optical system. Namely, when assembling the diffraction grating C, it is initially assembled with its irregularities D roughly set, and then, after it is confirmed whether the irregularities D of thus assembled diffraction grating C are in a proper orientation or not, the orientation of the irregularities D must be minutely adjusted so as to yield an optical characteristic. These operations for setting and confirming the orientation of the irregularities D take up an enormous amount of time, thereby becoming a major obstacle to improvement in efficiency of the step of assembling the light pickup optical system.

In order to overcome the foregoing problems, it is an object of the present invention to provide a storage case for a diffraction grating which can improve efficiency in the operation for assembling the diffraction grating.

The storage case for a diffraction grating in accordance with the present invention comprises a plurality of storage sections each forming a storage space for accommodating a diffraction grating; and engaging means, formed in the storage space, for engaging an outer peripheral portion of the diffraction grating.

Preferably, in the storage case for a diffraction grating in accordance with the present invention, the engaging means is formed at the same position within the storage space in each storage section.

In accordance with the present invention, the engaging means engages the outer peripheral portion of the diffraction grating accommodated in the storage space, whereby the diffraction grating can be accommodated in a desired orientation. Thus accommodated diffraction grating would not rotate within the storage section. Consequently, each diffraction grating is in substantially a constant orientation when being assembled into a light pickup optical system. Accordingly, operations for adjusting and confirming the orientation of the diffraction grating can be omitted, whereby the operation for assembling the diffraction grating can be carried out efficiently.

In the storage case for a diffraction grating in accordance with the present invention, the bottom face of the storage space may be provided with a through hole which is at least smaller than the diffraction grating accommodated therein.

In this case, the optical surface of the accommodated diffraction grating can be visually inspected by way of the through hole. Also, dust and the like attached to the optical surface of the diffraction grating can be easily removed by blowing air via the through hole.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

In the following, various embodiments of the present invention will be explained with reference to the accompanying drawings. Here, among the drawings, constituents identical to each other will be referred to with numerals or letters identical to each other without their overlapping explanations repeated.

Figure 1:
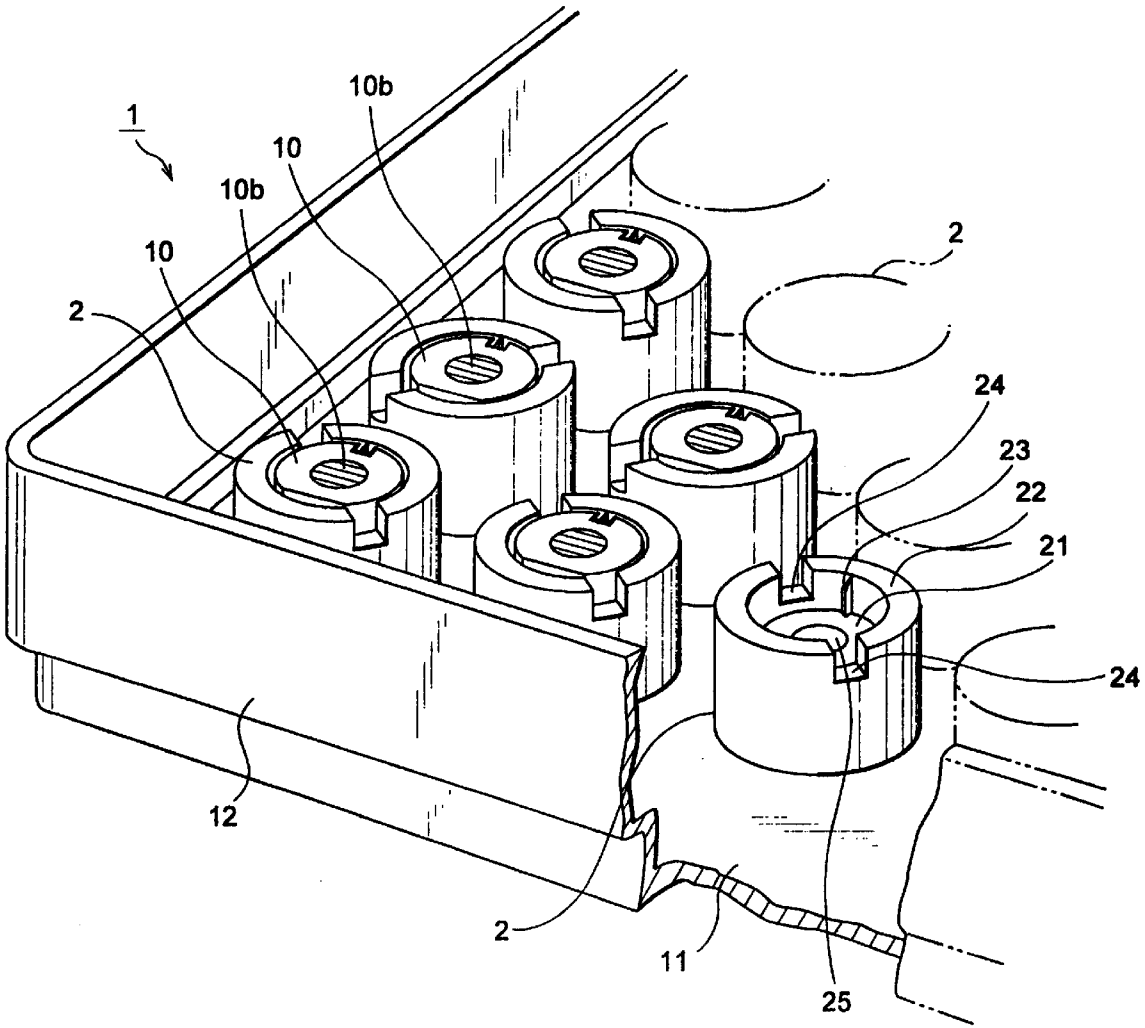
FIG. 1 is an explanatory view of a storage case in accordance with the present invention.
Figure 2:
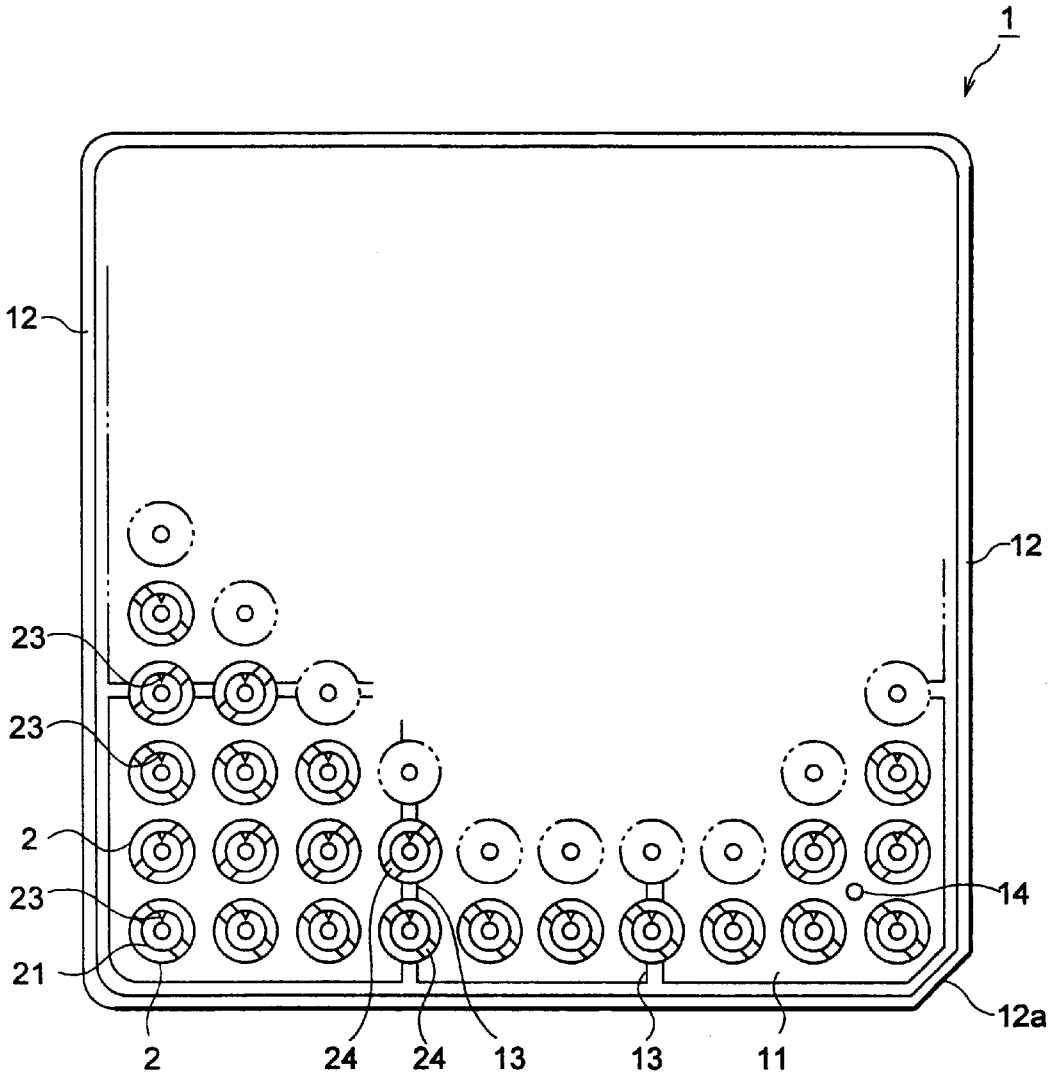
FIG. 2 is a plan view of the storage case.

FIG. 1 is a perspective view showing a part of a storage case for diffraction gratings. FIG. 2 is a plan view of the storage case for diffraction gratings. For convenience of explanation, FIG. 1 shows the storage case in the state lacking a part thereof. Also, FIG. 2 omits a part of storage sections.

As shown in FIG. 1, a storage case 1 is formed with a plurality of storage sections 2. As shown in FIG. 2, a plurality of storage sections 2, each of which is used for accommodating a diffraction grating 10, are arranged into a matrix on a bottom plate 11. For example, 100 pieces in total of storage sections 2 are arranged in 10 rows by 10 columns.

As shown in FIG. 1, each storage section 2 has a cylindrical form and projects upward from the upper face of the bottom plate 11. The storage section 2 is formed with a storage space 21 for accommodating the diffraction grating 10. The storage space 21 is formed as the top face 22 of the storage section 2 is recessed downward, such that the diffraction grating 10 can be accommodated therein with its optical surfaces held perpendicular to the vertical direction. For example, the storage space 21 has substantially a circular horizontal cross section, and its depth is slightly greater than the thickness of the diffraction grating 10.

Figure 3:
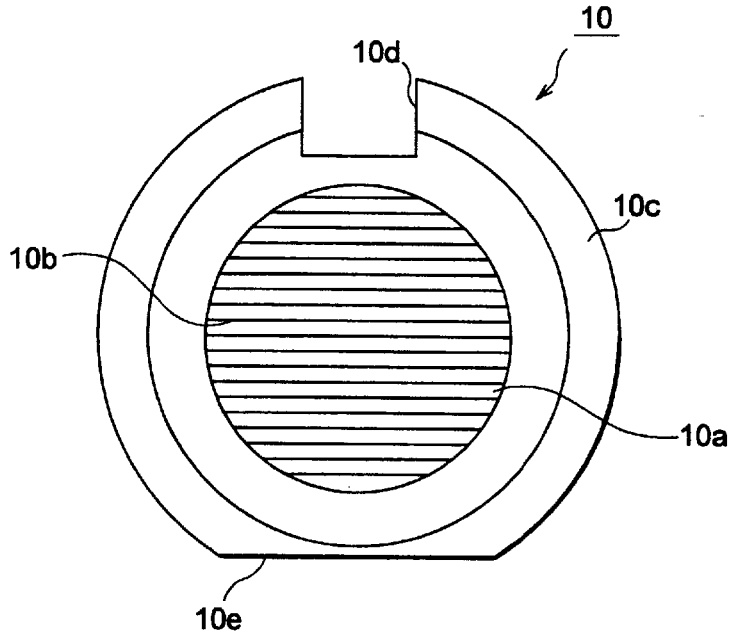
FIG. 3 is an explanatory view of a diffraction grating to be accommodated.
Figure 4:
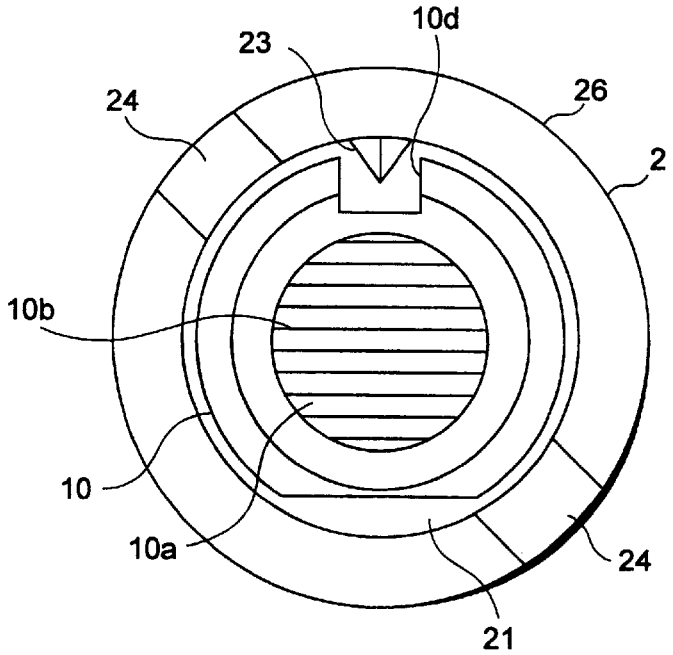
FIG. 4 is an explanatory view showing the state of accommodation of the diffraction grating.

FIG. 3 is a plan view of the diffraction grating 10 to be accommodated in the storage section 2. FIG. 4 is an explanatory view showing the state of accommodation of the diffraction grating 10. In FIG. 3, the front and rear faces of the diffraction grating 10 are both provided with optical surfaces transmitting light therethrough. One of the optical surfaces is formed with a diffracting portion 10*b* for diffracting light. For example, the diffracting portion 10*b* is formed by irregularities on the optical surface. The diffracting portion 10*b*, having its irregularities oriented in a predetermined direction (in the lateral direction in FIG. 3), diffracts light emitted from the optical surface.

Also, as shown in FIG. 3, a flange 10*c* is formed around the optical surface 10*a*. The flange 10*c* is used as an attachment for the diffraction grating 10. The flange 10 is provided with a cutout portion 10*d*. The cutout portion 10*d*, which is a positioning groove used for adjusting the rotational position of the diffraction grating 10 when assembling the diffraction grating 10 into a light pickup optical system, is formed by cutting out a part of the outer edge of the flange 10*c*, for example, into a U-shaped cross section as shown in FIG. 3. The cutout section 10*d* is formed at a position opposite to a gate-cut face 10*e* across the optical axis of the diffraction grating 10 and has a predetermined positional relationship with respect to the direction of orientation of the irregularities in the diffraction grating 10. For example, as shown in FIG. 3, the cutout portion 10*d* is formed at a position distanced from the center (optical axis) of the diffraction grating 10 in a direction (vertical direction in FIG. 3) orthogonal to the direction of orientation (lateral direction in FIG. 3) of the irregularities in the diffracting portion 10*b*. Consequently, as the orientation of the cutout portion 10*d* is adjusted in the diffraction grating 10, the direction of orientation of the irregularities in the diffracting portion 10*b* can be appropriately regulated.

Though the above-mentioned diffraction grating 10 is provided with one cutout portion 10*d*, a plurality of cutout portions 10*d* may be formed at different positions of the diffraction grating 10 as well.

As shown in FIG. 1, the storage space 21 of the storage section 2 is provided with a rib 23. The rib 23, which is an engaging member for engaging an outer peripheral portion of the diffraction grating 10 accommodated in the storage space 21, is formed on the inner face of a side wall 26 defining the storage space 21, for example, and extends in the vertical direction. Also, as shown in FIG. 4, the height (length projecting from the inner face of the side wall 26) of the rib 23 is smaller than the cutout depth of the cutout portion 10*d* of the diffraction grating 10 but within such a range as to engage the cutout portion 10*d* of the diffraction grating 10 and keep it from dropping out. As the rib 23 is formed in the storage space 21, the cutout portion 10*d*, which is a positioning groove for the diffraction grating 10, can be utilized for engaging the latter, whereby the diffraction grating 10 can be securely prevented from rotating within the storage space 21.

In each storage section 2, the rib 23 is formed at the same position within the storage space 21. For example, as shown in FIG. 1, in each storage section 2, the rib 23 is uniformly formed at the side wall 26 of the inner side (upper right side in FIG. 1) of the storage space 21. Thus, as the rib 23 engages the diffraction grating 10 accommodated in each storage section 2, all the diffracting portions 10*b* are oriented in the same direction (lateral direction in FIG. 1).

As shown in FIG. 1, the top face 22 of the storage section 2 is provided with grooves 24, 24. Each groove 24, which is used for taking out the diffraction grating 10 from the storage space 21 by forceps, is formed by recessing the top face 22 downward and communicates the storage space 21 to the outside thereof. Each storage section 2 is provided with a pair of grooves 24, 24 which are formed at positions opposing each other across the storage space 21. As a consequence, the diffraction grating 10 accommodated in the storage space 21 can be easily taken out therefrom as being held by forceps.

Also, each groove 24 is formed so as not to align with the groove 24 of its adjacent storage section 2. For example, as shown in FIG. 2, while the grooves 24 of each storage section 2 are formed substantially in parallel to a diagonal direction of the storage case 1 (direction from the lower left to upper right or from the lower right to upper left in FIG. 2), the orientation of the grooves 24 in the first row (the lowest row in FIG. 2) is in the lower right to upper left direction, that in the second row (the second lowest row in FIG. 2) is in the lower left to the upper right direction, that in the third row is in the lower right to upper left direction, and so forth, thus alternating the orientation of the grooves 24 row by row. In the case where the grooves 24 are formed in such a manner, when the diffraction grating 10 is taken out from the storage space 21 by means of a negative pressure type aspirator, the diffraction grating 10 can be taken out without affecting other diffraction gratings 10 accommodated in their corresponding storage spaces 21. Namely, the suction port of an air-evacuating aspirator is caused to approach the diffraction grating 10 accommodated in the storage space 21, abut to the diffraction grating 10, and then pull it up, whereby the diffraction grating 10 is taken out. Even when the air flows along the groove 24 upon suction of the diffraction grating 10, it would hardly flow into the grooves 24 of the adjacent storage section 2, whereby there are no shortcomings such as the diffraction grating 10 of the adjacent storage section 2 dropping out from the storage space 21. Similarly, upon mounting, influence of air blow on the diffraction grating 10 in the adjacent storage section 2 is small.

Figure 5:
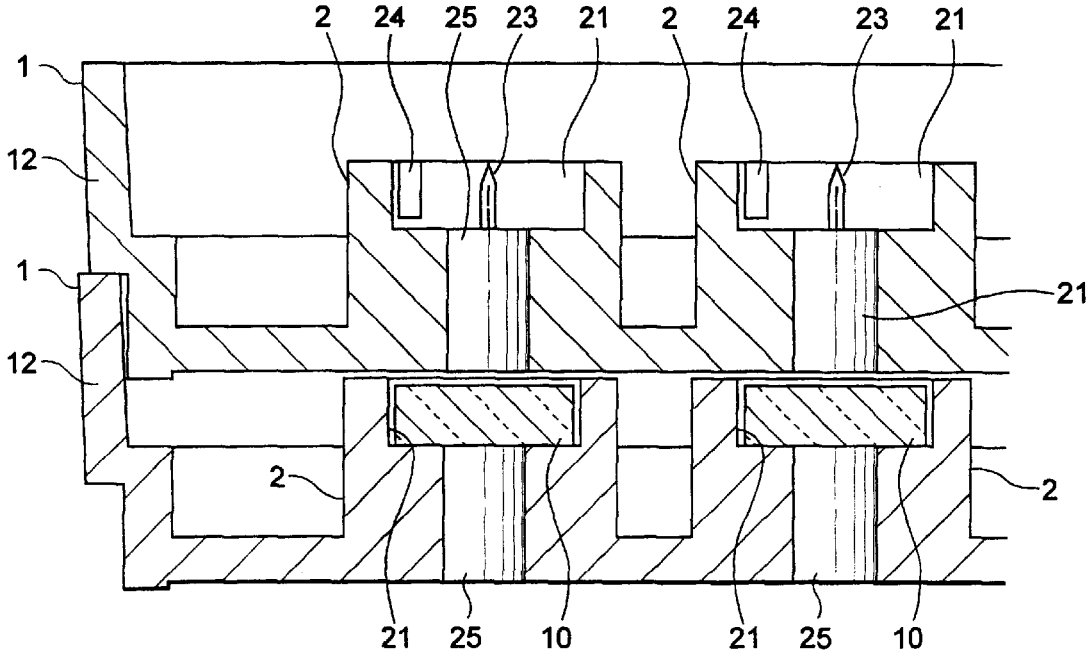
FIG. 5 is an explanatory view of storage cases.
Figure 6:
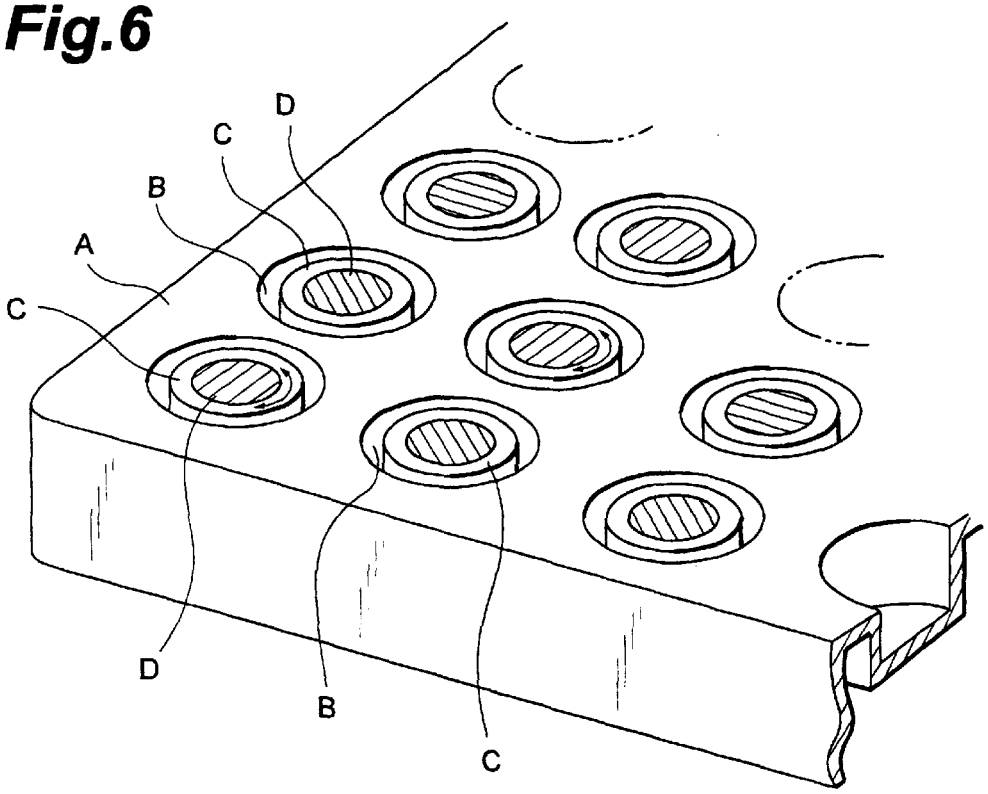
FIG. 6 is an explanatory view of a conventional storage case.

As shown in FIG. 1, the bottom face of the storage space 21 in the storage section 2 is provided with a through hole 25 communicating with the rear face of the storage case 1. The through hole 25 is formed with a diameter slightly greater than that of the optical surface of the diffraction grating 10. As shown in FIG. 1, the outer edge portion 12 of the storage case 1 rises up from the bottom plate 11 so as to extend to a position higher than the top face 22 of the storage section 2. The outer edge portion 12 is bent so as to yield a crank-shaped cross section with its upper part extending like a step. Consequently, as shown in FIG. 5, a plurality of storage cases 1 can be vertically stacked together mating their outer edge portions 12 with each other. Also, when the storage cases 1 are stacked together, while the diffraction grating 10 is held within the storage space 21, the optical surface of the diffraction gratings 10 can be visually inspected via the through hole 25. When dust and the like cling to the optical surface, the diffraction grating 10 can be blown with air by way of the through hole 25, thereby allowing the dust and the like to be easily removed therefrom.

As shown in FIG. 2, one corner 12*a* of the outer edge portion 12 of the storage case 1 is chamfered, for example, so as to be distinguishable from the other corners. As a consequence, the storage cases 1 are always oriented in a predetermined direction when vertically stacked. Also, as shown in FIG. 2, reinforcement ribs 13 are disposed on the bottom plate 11 of the storage case 1. The rigidity of the storage case 1 is enhanced by the ribs 13.

Also, as shown in FIG. 2, the bottom plate 11 of the storage case 1 is provided with a hole 14 penetrating therethrough. The hole 14 is used for positioning in an automatic machine (for mounting or assembling).

A method of using the storage case 1 will now be explained.

After being manufactured, the diffraction grating 10 is accommodated in the storage case 1 for shipment. As shown in FIG. 4, the diffraction grating 10 is put into the storage space 21 of the storage case 1. Here, unless the cutout portion 10*d* is located at the position where the rib 23 is formed, the diffraction grating 10 cannot be accommodated in the storage space 21. As a consequence, the diffraction grating accommodated in the storage space 21 attains a state where the rib 23 engages the cutout portion 10*d*, whereby its diffracting portion 10*b* is oriented in a desired direction (lateral direction in FIG. 4).

In the case where the diffraction grating 10 falls off from the storage section 2 onto the bottom plate 11 or the like during the operation of its accommodation, it can be easily accommodated into the storage space 21 by means of forceps or the like. For example, in this case, thus fallen diffraction grating 10 can be held with forceps, and the tip of the forceps in this holding state can be inserted into the grooves 24, 24 of the storage section 2 so as to guide the diffraction grating 10 into the storage space 21. Namely, the diffraction grating 10, in a held state, can be guided into the storage space 21, so as to be accommodated therein securely and easily.

After each diffraction grating 10 is accommodated in its corresponding storage section 2, all the diffracting portions 10*b* of the diffraction gratings 10 in the respective storage sections 2 would be oriented in the same direction as shown in FIG. 1. Since the rib 23 of each storage section 2 is formed at the same position with respect to its storage space 21, the diffraction grating 10 accommodated therein as being engaged by the rib 23 is oriented in the same direction, whereby its diffracting portion 10*b* is oriented in the same direction.

Then, when another storage case 1 is stacked on the storage case 1 accommodating therein the diffraction grating 10, the appearance of the diffraction grating 10 can be visually inspected. Since the bottom face of the storage space 21 is provided with the through hole 25 opening to the rear face of the storage case 1, the optical surface of the diffraction grating 10 can be visually observed by way of the through hole 25 while holding the diffraction grating 10 in the storage space 21. Here, since the diffraction gratings 10 are accommodated with their optical surfaces 10*b* oriented in the same direction, the optical surfaces 10*b* can be visually inspected while comparing one another, whereby damages formed in the optical surfaces 10*b* of the diffraction gratings 10 can be easily found out. In the case where thus accommodated diffraction grating 10 has damages, it will be taken out from the storage space 21 so as to be replaced with a new diffraction grating 10. Upon this operation, the tip of forceps can be inserted into the grooves 24, 24 of the storage section 2 so as to hold the diffraction grating 10 within the storage space 21, whereby the diffraction grating 10 can be taken out easily.

Also, when the dust and the like are found to cling to the optical surface of the diffraction grating 10 upon visual inspection of the diffraction grating 10, air is blown toward the through hole 25 of the storage case 1 while the diffraction grating 10 is held as shown in FIG. 5, whereby the dust and the like clinging to the optical surface of the diffraction grating 10 can be easily removed therefrom.

After the completion of visual inspection, the storage case 1 accommodating the diffraction grating 10, for example, as a part of a plurality of such storage cases stacked together, is shipped to a factory for assembling a light pickup optical system. At the time of this shipment, each diffraction grating 10 accommodated in the storage case 1 would not rotate within the storage space 21 since the rib 23 engages the outer peripheral portion (cutout portion 10*d* ) thereof. As a result, upon shipment, the orientation of the diffracting portion 10*b* of each diffraction grating 10 is securely held.

Then, at the receiving end, the light pickup optical system is assembled. In this assembling step, for example, an aspirator having a suction port for evacuating air is used for taking out the diffraction grating 10 from the storage case 1. The diffraction grating 10 is taken out by the aspirator as its suction port abuts to and pulls up the diffraction grating 10 accommodated in the storage space 21. Here, although the air flows along the grooves 24, 24 of the storage section 2 upon suction of the diffraction grating 10; since these grooves 24 do not align with those of the adjacent storage section 2, the air would hardly flow into the storage space 21 of the adjacent storage section 2, thus eliminating such shortcomings as the diffraction grating 10 of the adjacent storage section 2 dropping out from the storage space 21. Accordingly, when the diffraction grating 10 is taken out by means of a negative pressure type aspirator, this operation can be carried out without affecting the diffraction gratings 10 accommodated in other storage spaces 21.

Also, since all the diffraction gratings 10 within the storage case 1 are oriented in the same direction, the diffraction grating 10 taken out from the storage space 21 can be assembled into a light pickup optical system without adjusting the orientation thereof. Since the operation for confirming the orientation of the diffraction grating 10 can also be omitted here, the operation for assembling the diffraction grating 10 can be carried out efficiently.

Then, a pin or the like is inserted into the cutout portion 10*d* of the diffraction grating 10 assembled into the light pickup optical system, and the pin is moved so as to rotate the diffraction grating 10 about the optical axis, thereby minutely adjusting the latter to yield an optical performance. Thus, the operation for assembling the diffraction grating 10 is completed.

As mentioned above, in the storage case 1 in accordance with this embodiment, since the rib 23 engages the cutout portion 10*d* of the diffraction grating 10 accommodated in the storage space 21, the diffraction grating 10 can be accommodated in a desired orientation.

Also, thus accommodated diffraction grating 10 would not rotate within the storage section 2. As a consequence, when being assembled into the light pickup optical system, each diffraction grating 10 is in substantially a constant orientation. Accordingly, the operations for adjusting and confirming the orientation of the diffraction grating 10 can be omitted, whereby the operation for assembling the diffraction grating 10 can be carried out efficiently.

As the storage space 21 is formed with the through hole 25, visual inspection of the accommodated diffraction grating 10 can be performed efficiently. Also, when dust and the like cling to the accommodated diffraction grating 10, air can be blown toward the through hole 25, whereby the clinging dust and the like can be easily removed.

As the storage section 2 is formed with the grooves 24, the diffraction grating 10 accommodated in the storage space 21 can be easily taken out therefrom by means of forceps or the like, and the diffraction grating 10 can be easily accommodated into the storage space 21 as being held by forceps or the like.

Further, in the case where the grooves 24 of the storage sections 2 alternate their orientations row by row, the operation for taking out the diffraction grating 10 by air suction and the operation for mounting the diffraction grating 10 by air blow can be carried out without any influence of the air on other accommodated diffraction gratings 10.

As explained in the foregoing, the present invention can yield the following effects.

Namely, since an engaging member engages the outer peripheral portion of the diffraction grating accommodated in the storage space, the diffraction grating can be accommodated in a desired orientation.

Also, thus accommodated diffraction grating would not rotate within the storage section. Consequently, when being assembled into a light pickup optical system, each diffraction grating is in substantially a constant orientation, whereby the operations for adjusting and confirming the orientation of the diffraction grating can be omitted, thus allowing the operation for assembling the diffraction grating to be carried out efficiently.

Further, as the bottom face of the storage space is provided with a through hole, the optical surface of the diffraction grating can be visually inspected via this through hole. Also, the dust and the like clinging to the optical surface of the diffraction grating can be easily removed when air is blown by way of the through hole.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A storage case for diffraction gratings, said storage case comprising:

a plurality of storage sections, each storage section including a storage space for accommodating a diffraction grating, each storage section including a bottom face having a through hole; and engaging means, in each storage space, for engaging an outer peripheral portion of a diffraction grating.

2. The storage case for diffraction gratings according to claim 1, wherein said engaging means is disposed in the same position within the storage space in each storage section.

3. The storage case for diffraction gratings according to claim 1 further comprising a plurality of diffraction gratings, each diffraction grating being disposed in a respective storage section, each diffraction grating including a diffraction portion having irregularities, the irregularities being oriented in the same direction with respect to the diffraction portion.

4. A storage case for diffraction gratings, the storage case comprising:

a plurality of storage sections, each storage section including a storage space for accommodating a diffraction grating;

engaging means, in each storage space, for engaging a diffraction grating, preventing rotation of the diffraction grating within the storage space; and a plurality of diffraction gratings, each diffraction grating being disposed in a respective storage section, each diffraction grating including a diffraction portion having irregularities, the irregularities being oriented in the same direction with respect to the diffraction portion.

5. A storage case for diffraction gratings, the storage case comprising:

a plurality of storage sections, each storage section including a storage space for accommodating a diffraction grating, wherein the storage space includes a bottom face having a through hole smaller than a diffraction grating; and engaging means, in each storage space, for engaging a diffraction grating, preventing rotation of the diffraction grating within the storage space.

6. A storage unit storing diffraction gratings comprising:

a plurality of storage sections, each storage section defining a storage space;

a plurality of diffraction gratings, each diffraction grating having an outer periphery and a cutout portion on the outer periphery, each diffraction grating being disposed in a respective storage space; and engaging means in each storage space for engaging the cutout portion of the diffraction grating in the storage space.

7. The storage unit having diffraction gratings according to claim 6, wherein each diffraction grating includes a diffraction portion having irregularities, the irregularities being oriented in the same direction with respect to the cutout portion of the diffraction portion.

8. The storage unit storing diffraction gratings according to claim 7, wherein the engaging means is located at the same position in the storage space in each of the storage sections.

9. The storage case storing diffraction gratings according to claim 6, wherein the storage space includes a bottom face having a through hole smaller than a diffraction grating accommodated in the storage space.

* * * * *